United States Patent [19]

Mathieu

[11] 4,444,609

[45] Apr. 24, 1984

[54] WEAR MEMBER FOR RAILWAY VEHICLE AND METHOD OF MAKING SAME

[75] Inventor: Julien C. Mathieu, Waynesville, N.C.

[73] Assignee: Dayco Corporation, Dayton, Ohio

[21] Appl. No.: 424,683

[22] Filed: Sep. 27, 1982

Related U.S. Application Data

[62] Division of Ser. No. 235,498, Feb. 19, 1981.

[51] Int. Cl.[3] ..... B21D 53/10; B31F 1/20

[52] U.S. Cl. ..... 156/210; 29/149.5 NM; 29/149.5 S; 105/225; 156/292; 156/313; 308/3 R

[58] Field of Search ..... 156/210, 292, 313; 105/225, 307; 308/3 R, DIG. 8; 29/149.5 R, 149.5 S, 149.5 NM, 149.5 DP

[56] References Cited

U.S. PATENT DOCUMENTS

| | | | |
|---|---|---|---|
| 1,302,564 | 5/1919 | Klocke | 29/149.5 |
| 2,474,008 | 6/1949 | Meyer | 105/225 |
| 3,397,102 | 8/1968 | Schraub | 308/3 R |
| 3,831,258 | 8/1974 | Elbert et al. | 29/149.5 S |
| 4,001,124 | 1/1977 | Hussey | 105/225 |
| 4,327,474 | 5/1982 | Holden et al. | 29/149.5 NM |

*Primary Examiner*—Jerome W. Massie

*Attorney, Agent, or Firm*—Joseph V. Tassone

[57] ABSTRACT

A method of making a wear member for a railway vehicle is described, a wear member having a U-shaped support that is provided with a bight and a pair of parallel legs and carrying on the bight thereof anti-friction polymeric material. The support is made of structural material of substantially uniform thickness throughout, the structural material having a plurality of corrugations defining the bight of the support with each corrugation having the uniform thickness throughout substantially its entire configuration and having an end surface spaced from and coplanar with the end surfaces of the corrugations adjacent thereto whereby the corrugations provide structural strength for the bight of the support, the polymeric material being supported by certain of the corrugations at just the adjacent and coplanar end surfaces thereof.

6 Claims, 7 Drawing Figures

WEAR MEMBER FOR RAILWAY VEHICLE AND METHOD OF MAKING SAME

This is a division of application Ser. No. 235,498, filed Feb. 19, 1981.

BACKGROUND OF THE INVENTION

1. Field of the Invention

This invention relates to a wear member for a railway vehicle and to a method of making such a wear member.

2. Prior Art Statement

Wear members are used in various applications in the railway industry for the purpose of protecting relatively movable components against excessive wear. Examples of railway vehicle wear members are presented in the following items:

(1) U.S. Pat. No. 3,554,618,
(2) U.S. Pat. No. 4,170,180,
(3) U.S. Pat. No. 4,238,039,
(4) U.S. Pat. No. 4,239,007, and
(5) U.S. Pat. No. 4,313,384.

It appears from item (1) that a wear member, in the form of a U-shaped pedestal liner, is provided which consists of a bight and a pair of parallel legs wherein the parallel legs serve as mounting brackets for the pedestal liner and the bight has an inserted nylon wear plate which is unsupported in the central portion of the bight.

It appears from item (2) that a pedestal liner is provided which consists of two main components, both made of elastomeric material, and wherein one component is U-shaped and has a flat bight and parallel legs which are provided with so-called spacing washers and the other component is a sheet-like insert.

It appears from item (3) that a wear member is provided comprised of a support having a continuous supporting surface and an ultra high molecular weight polymeric material is attached to the supporting surface by utilizing attaching means comprised of a metal structure.

It appears from item (4) that a U-shaped pedestal liner is provided which comprises a continuous uninterrupted sheet-like backing material defining the bight and parallel legs thereof and wherein ultra high molecular weight polymeric material is supported by the backing material.

It appears from item (5) that a U-shaped pedestal liner is provided comprised of a roughly U-shaped metal support which employs an insert which is readily installed and removed.

However, railway vehicle wear members including coupler carrier wear members, pedestal liners, and the like generally utilize support structures or supports for antifriction components thereof which have various deficiencies. Typical deficiencies include the use of excessive amounts of comparatively expensive material to define the support whereby the associated wear member is not cost competitive; or, the use of insufficient amounts of material or poor design resulting in the support having inadequate structural strength for its intended function.

It is an object of this invention to provide an improved wear member for a railway vehicle.

Another object of this invention is to provide an improved wear member for a railway vehicle wherein such wear member is a pedestal liner.

Another object of this invention is to provide an improved method of making a wear member.

Other aspects, embodiments, objects, and advantages of this invention will become apparent from the following specification, claims, and drawings.

SUMMARY

In accordance with the present invention there is provided an improved wear member for a railway vehicle which overcomes the above-mentioned deficiencies. The improved wear member is adapted to be used on a railway vehicle which comprises a pair of relatively movable components and the wear member is adapted to be supported by one of the components and protects the components from wear during relative movement thereof and such wear member comprises a support adapted to be supported by the one component and a polymeric material carried by the support and having a smooth antifriction outer wear surface which is adapted to engage the other component with the polymeric material comprising an ultra high molecular weight material.

In accordance with one embodiment of this invention the support of the improved wear member is made of a structural material of substantially uniform thickness throughout with the material having a plurality of corrugations comprising at least a portion thereof with each corrugation having the uniform thickness thoughout substantially its entire configuration and having an end surface spaced from and coplanar with the end surfaces of the corrugations adjacent thereto provide structural strength for the said portion.

In accordance with another embodiment of this invention there is provided a pedestal liner for a railway vehicle wherein the vehicle comprises, pedestal trucks comprising pairs of pedestal legs, a journal box disposed between each associated pair of pedestal legs with each journal box having a vertically disposed planar guide surface and a pair of spaced vertically disposed parallel side surfaces disposed on opposite sides of the guide surface and with the pedestal liner being roughly U-shaped and comprising a bight and a pair of parallel legs and being adapted to be disposed between an associated pedestal leg and journal box and fastened to the associated pedestal leg, a roughly U-shaped support comprising the main structural portion of the liner with the support also having a bight and a pair of parallel legs, antifriction polymeric material for the parallel legs of the liner supported by the support and adapted to engage the side surfaces, and antifriction polymeric material for the bight of the liner supported by the support and adapted to engage the guide surface with the antifriction polymeric material being ultra high molecular weight polymeric material and wherein the support is made of a structural material of substantially uniform thickness throughout with the structural material having a plurality of corrugations comprising the bight of the support with each corrugation having a uniform thickness throughout substantially its entire configuration and having an end surface spaced from and coplanar with the end surfaces of the corrugations adjacent thereto provide structural strength for the bight of the support the polymeric material where the bight of the support being supported by certain of the corrugations at just the adjacent and coplanar end surfaces thereof.

Also provided in accordance with this invention is an improved method of making a railway vehicle wear member of the character mentioned.

BRIEF DESCRIPTION OF THE DRAWINGS

The accompanying drawings show present preferred embodiments of this invention, in which.

DETAILED DESCRIPTION

Figure 1:
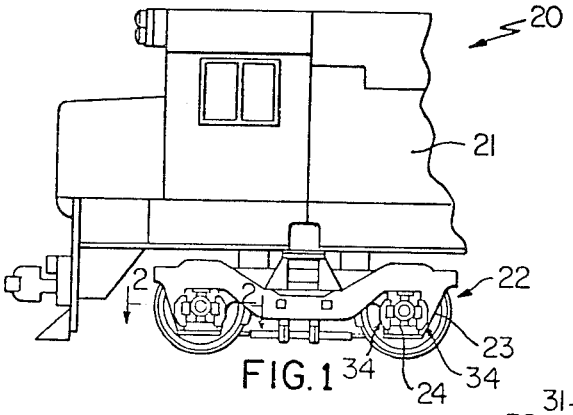
FIG. 1 is a fragmentary side view of a railway locomotive which utilizes pedestal trucks at its opposite ends, with only one truck being shown, wherein each truck has pairs of pedestal legs and a journal box disposed between each pair of associated pedestal legs with a pedestal liner of this invention being disposed between each associated pedestal leg and journal box.

Reference is now made to FIG. 1 of the drawings which illustrates a fragmentary end portion of a railway vehicle, i.e., a railway locomotive 20, and such locomotive comprises the usual main body 21 which is supported at each of its opposite ends by a four wheel truck and with only one of the trucks being shown in FIG. 1 and designated generally by the reference numeral 22. The exemplary truck 22 is a well known pedestal type truck and comprises four pairs of pedestal legs with a typical one of such pedestal legs being illustrated in an enlarged view in FIG. 2; and, each leg of each pair is designated by the reference numeral 23. The truck 22 has the usual journal box 24 disposed between each associated pair of legs 23.

Each journal box 24 has a vertically disposed central planar guide surface 25 and a pair of spaced vertically disposed parallel side surfaces 26 disposed on opposite sides of each central guide surface 25. Each central guide surface 25 defines the outside surface of an associated wear plate 27 which is fixed to the main body 30 of the journal box 24 by suitable means, such as weld means, or the like. The parallel side surfaces 26 of the journal box define the outside surfaces of metal plate members 31 which are suitably fixed to integral extensions 32 which extend from the main body 30 of the journal box 24.

Figure 2:
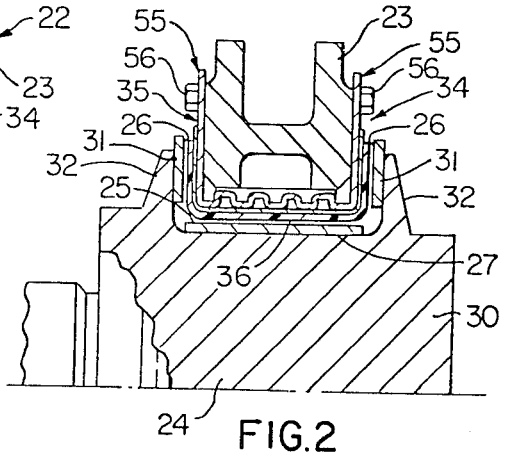
FIG. 2 is a fragmentary view with parts in cross section and parts in elevation and taken essentially on the line 2—2 of FIG. 1, illustrating a typical pedestal liner of this invention disposed in position between an associated journal box and pedestal leg.
Figure 3:
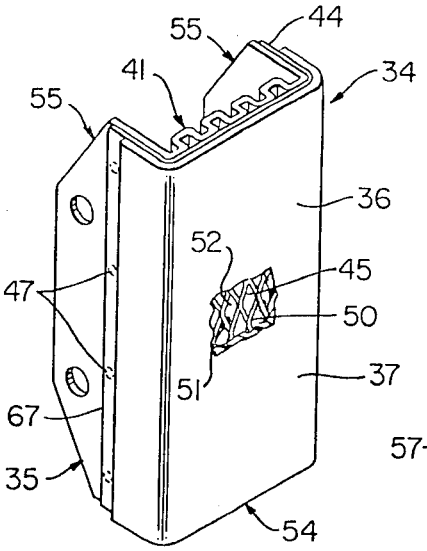
FIG. 3 is an isometric view of the pedestal liner of FIGS. 1 and 2 with a fragment broken away from the center portion thereof.

In accordance with the teachings of this invention an improved wear member, in the form of a U-shaped pedestal liner, is provided and designated by the reference numeral 34 in FIGS. 2 and 3. The wear member or pedestal liner 34 is adapted to be supported by one of the components of the railway vehicle 20 and in this example of the invention is adapted to be supported by an associated pedestal leg 23. The pedestal liner 34 protects the pedestal leg 23 and its relatively movable journal box 24, by protecting the associated components thereof which come into sliding engagement, from wear during relative movement between the pedestal leg 23 and journal box 24 during normal operation of the vehicle 20.

The wear member or pedestal liner 34 comprises a support 35 which is adapted to be supported by the one component or pedestal leg 23 and a polymeric material 36 carried by the support 35 in a manner to be described in detail subsequently and the polymeric material 36 has a smooth anti-friction outer surface 37 which is adapted to engage journal box 24 and in particular surface 25 of wear plate 27 and surfaces 26 of wear plates 31 comprising the journal box 24. The polymeric material 36 is preferably an ultra high molecular weight polymeric material and will be described in more detail subsequently.

Figure 4:
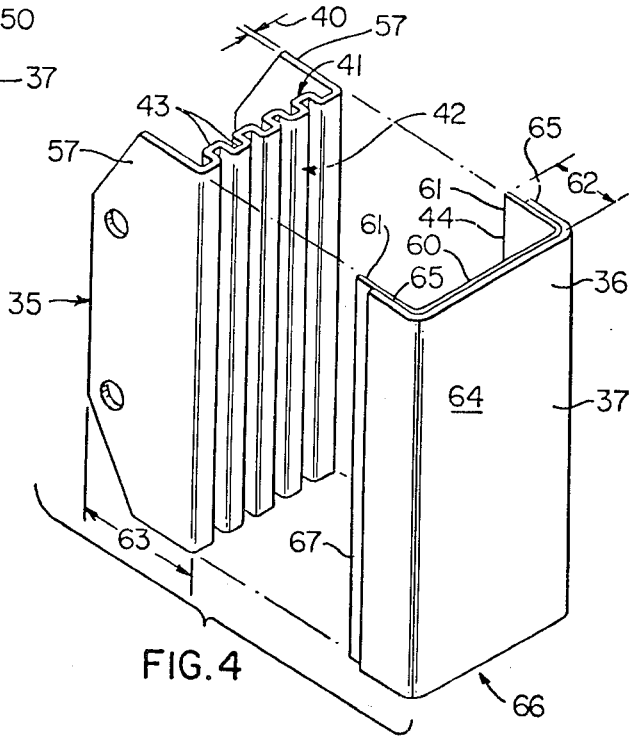
FIG. 4 is an exploded isometric view of the pedestal liner of FIG. 3 particularly illustrating the improved support of this invention exploded from the remaining assembled pedestal liner.

In accordance with the teachings of this invention, and as best illustrated in FIG. 4 of the drawing, the support 35 is made of a structural material having a substantially uniform thickness 40 throughout and such structural material has a plurality of corrugations which are designated generally by the reference numeral 41 and comprise at least a portion 42 thereof. The corrugations enable the substantially uniform thickness 40 to be comparatively small for a predetermined and desired structural strength of the portion 42.

The corrugations 41 have substantially U-shaped cross-sectional configurations as will be readily apparent in FIG. 4; and, each U-shaped corrugation will be designated by the reference numeral 43 with only a representative few of such corrugations being thus designated.

The wear member or pedestal liner 34 comprises an intermediate member 44 which is disposed between the polymeric material 36 and the support 35. The liner 34 has first means, designated generally by the reference numeral 45 in FIG. 3, provided for fixing the polymeric material 36 to the intermediate member 44 and such first fixing means 45 will be described in detail subsequently. The wear member 34 also has second means fixing the intermediate member 44 to the support 35; and, in this example of the invention wherein the support 35 and the intermediate member 44 are made of the same metal or compatible metallic materials, the second means provided for fixing the intermediate member 44 to the support 35 preferably comprises a plurality of metal spot welds 47, with a representative few of such spot welds being thus designated.

As previously mentioned, first fixing means 45 is provided for fixing the polymeric material 36 to the intermediate member 44 and such fixing means 45 comprises a metal structure 50 which is fixed to the intermediate member by suitable means which may comprise spot welds 51. The metal structure 50 is embedded between opposed surfaces of the polymeric material 36 and such polymeric material serves as a matrix for and substantially completely surrounds the metal structure 50. The metal structure 50 has openings 52 therein which receive the polymeric material completely therethrough and thereby provide better embedment of the metal structure 50. The metal structure 50 serves the multiple purpose of fixing the polymeric material 36 against the intermediate member 44 while also providing reinforcement for and preventing cold flow of such polymeric material. The manner in which the metal structure 50 is utilized to fix the polymeric material 36 to the intermediate member 44 is similar to techniques described in U.S. patent application Ser. No. 27,340, mentioned above, and the disclosure of such application is incorporated herein by reference thereto.

As will be readily apparent from FIGS. 2–4 of the drawings, the wear member or pedestal liner 34 is roughly U-shaped and comprises a bight which is designated generally by the reference numeral 54 and a pair of parallel legs each designated generally by the same reference numeral 55. The U-shaped pedestal liner is adapted to be disposed between an associated pedestal leg 23 and journal box 24 as previously mentioned and fastened to the associated pedestal leg using threaded bolts 56.

The pedestal liner 34 has the previously described support 35 thereof which is also roughly U-shaped and comprises the main structural portion of the liner 34. The support 35 has the bight 42 thereof which is corrugated, as previously mentioned, and a pair of parallel legs 57; and, the bight 42 and parallel legs 57 of the support comprise the bight 54 and parallel legs 55 of the overall pedestal liner 34.

As described earlier, the pedestal liner 34 has an intermediate member 44 disposed between the polymeric material 36 and the support 35. The intermediate member 44 also has a roughly U-shaped configuration defined by a flat planar bight 60 and a pair of parallel legs each designated by the same reference numeral 61. As seen in FIG. 4, the legs 61 have less extension or length 62 than the extension 63 of the legs 57 of the support 35.

The pedestal liner 34 has the antifriction polymeric material 36 comprising same and such polymeric material comprises a portion 64 for the bight 54 of such liner which is adapted to engage the guide surface 25 and portions 65 for the parallel legs of the liner 34 which are adapted to engage the side surfaces 26. The polymeric material 36 is a single-piece of material covering all of the flat planar bight 60 of the intermediate member 44 and the major area of each of the pair of parallel legs 61 of member 44. The first fixing means 45 previously described is used to fix the entire piece of polymeric material 36 to the intermediate member 44 and preferably this is achieved with member 44 and polymeric material in a flat configuration (before forming same) using techniques described in the above-mentioned U.S. patent application Ser. No. 27,340. The polymeric material 36 and the member 44 are then formed to define the U-shaped configuration in both of these components and as illustrated at 66 in the right-hand portion of FIG. 4.

The first means 45 is used to fix the polymeric material 36 to the intermediate member 44, usually by forming such polymeric material 36 in position, whereby an exposed rectangular strip 67 of the metal member 44 is provided outwardly of the polymeric material 36 on each side of the liner 34. The exposed metal strip 67 enables the spot welds 47 to be easily provided to fix the intermediate member 44 to the support 35.

The plurality of corrugations 41 comprising the bight 42 of the support 35 are U-shaped corrugations 43 disposed in parallel relation. With the exemplary pedestal line 34 fastened to its associated pedestal leg 23 the plurality of corrugations are vertically disposed.

Figure 5:
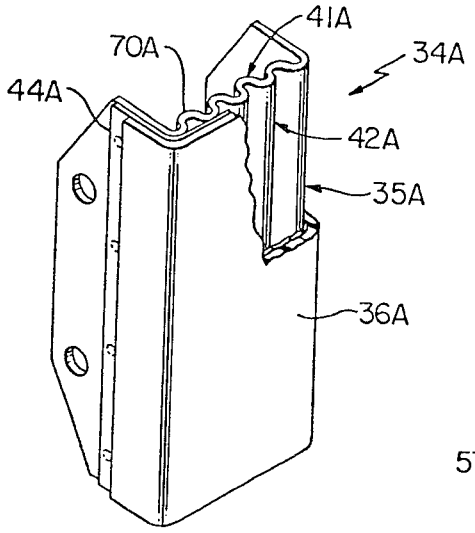
FIG. 5 is a view similar to FIG. 3 with a corner portion broken away and illustrating another exemplary embodiment of the pedestal liner of this invention.
Figure 6:
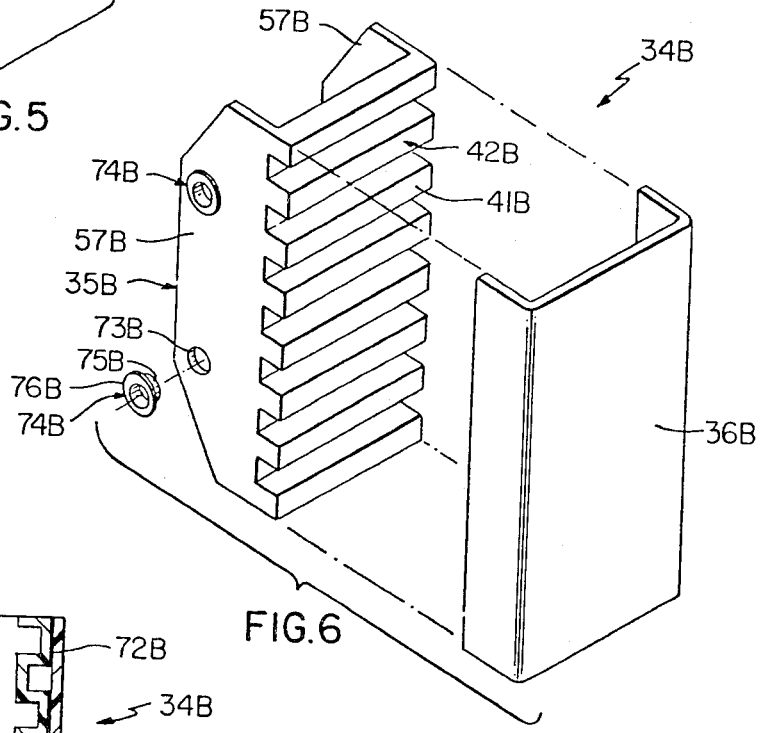
FIG. 6 is a view similar to FIG. 4 illustrating another exemplary embodiment of the pedestal liner of this invention.
Figure 7:
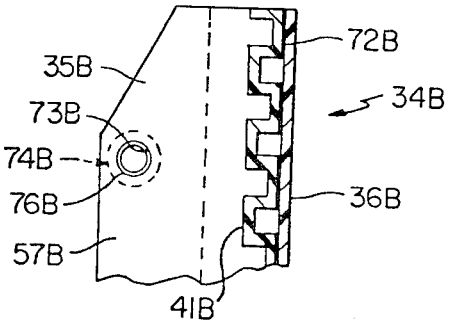
FIG. 7 is a fragmentary cross-sectional view of the liner of FIG. 6 in its assembled relation particularly illustrating outer polymeric material fastened to its support.

Other exemplary embodiments of wear members in the form of pedestal liners, of this invention are illustrated in FIGS. 5 and 6–7 of the drawings. The pedestal liners of FIGS. 5 and 6–7 are very similar to the pedestal liner 34; therefore such pedestal liners will be designated generally by the reference numerals 34A and 34B respectively and component parts of each pedestal liner 34A and 34B which are similar to corresponding parts of the pedestal liner 34 will be designated by the same reference numerals as in the pedestal liner 34 also followed by the associated letter designation, either A or B, and not described again in detail. Only those component parts of each pedestal liner 34A and 34B which are substantially different from corresponding parts of the pedestal liner 34 will be designated by new reference numerals also followed by the associated letter designation and described in detail.

The pedestal liner 34A of FIG. 5 is substantially identical to the liner 34 and is comprised of a support 35A, a polymeric material 36A, and an intermediate member 44A suitably fixed together in the manner previously described. The only difference between the pedestal liner 34 and the pedestal liner 34A is that the pedestal liner 34A has corrugations 41A therein which have a substantially sinusoidal configuration when viewed from an end thereof. The sinusoidal configuration is defined by cooperating rounded corrugations or convolutions 70A in the bight 42A of the support 35A and the sinusoidal corrugations 70A are arranged in parallel relation and disposed vertically when viewed with the pedestal liner fastened to its associated pedestal leg.

The pedestal liner 34B of FIGS. 6–7 has two main components which are both preferably made of polymeric material in the form of synthetic plastic material whereby such pedestal liner comprises a support 35B and an outer U-shaped member 36B made of polymeric material. The support 35B is preferably made using any suitable high strength structural plastic material. For example, a plastic material comprised of three monomers (acrylonitrile, butadiene, and styrene) and referred to in the art as ABS may be used. The support 35B may be made by any suitable technique known in the art, such as, injection molding for example.

The support 35B comprises integral bight 42B and parallel legs 57B; and, a plurality of parallel corrugations 41B are provided in the bight 42B. The parallel corrugations 41B of this example are defined such that with the pedestal liner 34B fastened to its associated pedestal leg 23 the corrugations 41B are horizontally disposed.

The pedestal liner 34B has polymeric material 36B comprising same which is of U-shaped configuration; and, although in this example of the invention the polymeric material 36B is unreinforced such polymeric material may be suitably reinforced, if desired. The polymeric material 36B may be formed and shaped using any technique known in the art and after shaping thereof is suitably fixed against the support 35B utilizing suitable fixing means which may be in the form of adhesive means 72B.

The support 35B has parallel legs 57B, as previously mentioned, extending from opposite ends of its bight 42B and each of the parallel legs 57B has a plurality of openings 73B therein for the purpose of mounting the pedestal liner 34B on an associated pedestal leg. The pedestal liner 34B has a plurality of protective metal inserts 74B each comprised of a sleeve like portion 75B adjoined at one end by a washer-like portion 76B. Each insert 74B is to receive a fastener such as a threaded fastening bolt 56 therethrough to enable fastening of the support 35B and hence the overall pedestal liner 34B in position on its associated pedestal leg 23 without elongation of the holes 73B and without cracking or damage of the structural plastic material in the vicinity of the holes 73B.

The metal structure, such as the metal structure 50 of the pedestal liner 34, which is used to attach or fix the polymeric material 36 to the intermediate member 44, which in turn is attached to the support 35, may be a grid-like expanded metal structure having openings 52 therein. The metal structure 50 may also be in the form of a wire mesh, plate structure having suitable openings or apertures therein, corrugated structure with suitable openings, or the like.

It will also be appreciated that the above reference to fixing of the polymeric material in position, such as to intermediate member 44, is intended to encompass separately defining the member 36 as a completed solid component and then attaching same in position as well as defining and forming the polymeric material 36 in position. In this latter instance (which is preferred, as indicated earlier) the polymeric material is defined as a flowable polymeric mass and is confined by a suitable mold device to define its shape while holding the mold device against the member 44 with the metal structure 50 fixed or welded in position. The flowable polymeric material 36 is adapted to flow around the metal structure 50 and through openings 52 thereof to define a matrix for the welded metal structure 50 embedding same in material 36 whereby the embeddment of metal structure 50 within the polymeric matrix material 36 results in such polymeric material being attached to the member 44.

The polymeric material 36 has been described herein as being an ultra high molecular weight polymeric material. Preferably such polymeric material is a ultra high molecular weight polyethylene having a molecular weight greater than 2 million and preferably the molecular weight is in the range of 4–6 million.

A description has been presented above of the detailed properties of the polymeric material 36; however, it is to be understood that such description is fully applicable to the polymeric material 36A and 36B. It is also to be understood the preferred technique for determining molecular weight of polymeric material 36, 36A, and 36B is referred to as the intrinsic viscosity test and is widely used in the United States.

Each metal support, intermediate member, and associated metal structure may be made of any suitable metal including ferrous or aluminous metal. However, it will be appreciated that the metal components being welded are preferably the same type of metal.

While present exemplary embodiments of this invention, and methods of practicing the same, have been illustrated and described, it will be recognized that this invention may be otherwise variously embodied and practiced within the scope of the following claims.

What is claimed is:

1. A method of making a wear member for a railway vehicle wherein said vehicle comprises a pair of relatively movable components and said wear member is adapted to be supported by one of said components and protects said components from wear during relative movement thereof, said method comprising the steps of, forming a U-shaped support having a bight and two leg portions which are adapted to be attached to said one component, and supporting polymeric material on the bight of said support, said polymeric material having a smooth anti-friction outer wear surface which is adapted to engage said other component, said polymeric material comprising an ultra high molecular weight polymeric material, the improvement in said method wherein said forming step comprises, providing a structural material of substantially uniform thickness throughout and defining a plurality of corrugations in at least a portion of the bight of said structural material, with each corrugation having said uniform thickness throughout substantially its entire configuration and having an end surface spaced from and coplanar with the end surfaces of the corrugations adjacent thereto, said corrugations providing structural strength to said portion, said polymeric material being supported by certain of said corrugations at just the adjacent and coplaner end surfaces thereof.

2. A method as set forth in claim 1 in which said defining step comprises defining said corrugations having substantially U-shaped cross-sectional configurations.

3. A method as set forth in claim 1 in which said defining step comprises defining said corrugations having a substantially sinusoidal configuration when viewed from an end thereof.

4. A method as set forth in claim 1 and comprising the further steps of forming an intermediate member, disposing said intermediate member between said polymeric material and said support, fixing said polymeric material to said intermediate member with first fixing means, and fixing said intermediate member to said support with second fixing means.

5. A method as set forth in claim 4 in which said forming steps comprise forming said support and said intermediate member of metal.

6. A method as set forth in claim 1 in which said forming step comprises forming said support of a structural plastic material and comprising the further step of adhesively fixing said polymeric material against said support.

* * * * *